United States Patent [19]

Petersson et al.

[11] 3,984,235

[45] Oct. 5, 1976

[54] TREATMENT OF CONVERTER SLAG

[75] Inventors: Stig Arvid Petersson; Sven Anders Lundquist, both of Skelleftehamn, Sweden

[73] Assignee: Boliden Aktiebolag, Stockholm, Sweden

[22] Filed: Dec. 26, 1973

[21] Appl. No.: 427,709

[30] Foreign Application Priority Data

Jan. 10, 1973 Sweden ..... 7300288

[52] U.S. Cl. ..... 75/73; 75/23; 75/24; 75/82; 75/88

[51] Int. Cl.[2] ..... C22B 15/00

[58] Field of Search ..... 75/72–77, 75/88, 23, 24, 82

[56] References Cited

UNITED STATES PATENTS

| | | | |
|---|---|---|---|
| 1,003,051 | 9/1911 | Korda | 75/75 |
| 2,295,219 | 9/1942 | Kalling et al. | 75/24 |
| 2,438,911 | 4/1948 | Gronningsaeter | 75/24 |
| 3,099,553 | 7/1963 | Aamot | 75/21 |
| 3,506,435 | 4/1970 | Themelis et al. | 75/72 |

*Primary Examiner*—M. J. Andrews

*Attorney, Agent, or Firm*—Stevens, Davis, Miller & Mosher

[57] ABSTRACT

A process for the production of copper from raw materials containing sulphur, zinc and more than 0.2% Ni calculated on the copper content. The material is melted to matte and the matte converted to white metal, whereafter the white metal is converted to copper and the zinc present in the slag obtained from the matte is fumed off in a furnace therefore. The slag formed during the conversion of matte to white metal is removed and treated in a separate furnace with an amount of copper, iron or nickel sulphide material sufficient to lower the copper content to less than 2%, whereafter the treated slag obtained is charged to the slag fuming surface.

8 Claims, No Drawings

TREATMENT OF CONVERTER SLAG

The present invention relates to a novel process for the production of blister copper from raw materials which contain copper, sulphur, zinc and more than 0.2% nickel calculated on the amount of copper. In the novel process the slab obtained from matte conversion in a conventional copper process is treated with a sulphide material.

Copper is usually produced by drying and partially roasting copper concentrates or by solely drying said concentrates, whereafter the concentrates, generally consisting of the elements Cu, Fe, and S together with $SiO_2$ are smelted in a smelting furnace. The furnace may be, for example, a flash smelter, tower furnace or an electric furnace. In this smelting process matte consisting chiefly of Fe-Cu-S is formed together with a slag phase. The slag is then separated from the matte and the matte is transferred from the smelter to a converter. When the slag contains zinc, the zinc may be recovered in a slag fuming furnace by reduction with carbon (for example) and fuming, whereafter a portion of the copper and nickel cntent of the slag is separated as mattes in a settling furnace. The matte can then be returned to the smelter or the copper converters to recover the copper content of the matte.

The slag which is treated in the slag fuming furnace has a composition normally falling within the content ranges of 35–50% FeO, 30–35% $SiO_2$, 0.3–1% Cu and up to 20% ZnO depending on the amount of zinc in the raw material being used. If zinc is present in quantities exceeding about 5%, it is economically advantageous to be able to fume the slag in which the zinc oxide is reduced to metallic zinc, which is gasified due to its higher volatility in comparison with zinc oxide. This kind of furnace usually consists of a furnace chamber bounded by bottom and walls suitably consisting of water-cooled steel pipes or boxes. This water-cooled furnace construction is primarily protected against atack by the hot slag, having a temperature of 12°–1,300°C, mainly by a layer of slag solidifying on the pipes or boxes.

It has found, however, that if the slag from the copper smelter has a copper content of more than 2%, there is a risk of serious corrosion damage to the bottom and walls of the fuming furnace. Experience has shown that if the copper content in the slag exceeds 2%, there is a precipitation of matte which collects on the bottom of the fuming furnace. When this happens, damage is caused by a reaction between $Cu_2S$ and steel according to the formula $Cu_2S + Fe \quad 2Cu + FeS$. At temperatures above 600°C this reaction is displaced to the left, while at temperatures under about 600°C it is displaced to the right. Owing to the water cooling of the furnace walls and bottom during a fuming process, the temperatures prevailing in the vicinity of the cooling pipes, are in practice considerably lower than 600°C, thus creating the conditions for the above-mentioned chemical attack. However, slag from the smelter generally contains only 0.3 – 1% Cu, and the slag can be treated in the slag fuming furnace without causing any trouble.

Matte from the copper smelter is taken to the copper converters, where blister copper is produced, by slagging-out the iron content of the matte while simultaneously blowing an oxygen-containing gas through the matte melt. Slag formation is brought about by an addition of $SiO_2$ (e.g. sand), causing the formation of a fayalite slag. Converter slag is usually composed of 25–50% FeO, 20–30% $SiO_2$, 4–8% Cu and up to 15% ZnO (depending on the amount of zinc in the raw material). It is unsuitable to charge the slag directly to the slag fuming stage, because of the high copper content of the slag. Consequently the slag is recycled to the copper smelter for copper beneficiation. However, converter slag contains large portions of the impurities found in the raw material, especially nickel and antimony. The recirculation of the converter slag to the smelter means that large quantities of nickel and antimony are accumulated in the process, and this in turn leads to high content of these elements in the blister copper. It is therefore desirable to treat the converter slag separately, instead of returning it to the smelter, in order to provide for the removal of nickel and antimony. Another inconvenience arising when slag is recirculated to the copper smelter is that the capacity of the smelter for smelting fresh raw material is decreased, and it is therefore of the greatest importance that the slag is separately treated before it is taken to the slag fuming furnace.

The liquid converter slag is normally removed from the converter at a time when blowing has brought about the white metal ($Cu_2S$) stage. The copper content of the slag can then reach about 4–8%. Due to the relatively high oxygen activity of the slag, copper oxide is formed which, in contrast to copper sulphide, is dissolved in the slag.

The expedient of avoiding recirculating converter slag to the smelter by treating the slag separately is previously known. Amongst the methods which have come into use here may be mentioned grinding-down of solidified slag followed by flotation or wind sieving. Scrubbing the copper content from molten slag with solid or molten sulphides is described in the Canadian patent 827,059 and the Swedish patent 108,991 for example. These patents only aim at reducing the copper and cobalt content, respectively, of the slag and are not combined with treatment in a slag fuming furnace intended to beneficiate the zinc content as well.

Hitherto there has been no success in obtaining an economically attractive method for treating converter slags rich in zinc and nickel. However, it has now been found that in those cases where the raw copper-bearing material not only contains copper but also sulphur and zinc, as well as nickel in amounts over 0.2% calculated on the amount of copper present in the raw material, the accumulation of nickel in the process can be avoided. According to the invention, slag formed during the formation of white metal is transferred to a special furnace, and treated therein with an amount of copper, iron or nickel sulphide material sufficient to lower the copper content to less than 2%, whereafter the slag thus obtained is treated further in a slag fuming oven.

In accordance with the new method the slag is scrubbed selectively during the sulphide treatment, whereat copper and also nickel are separated from the slag and transferred to the matte, Zn and Sb remaining to a great extent in the slag, which is then transferred to the slag fuming furnace. From the resulting matte, nickel and copper can be separated and beneficiated in a known way.

The sulphide material used is preferably copper pyrites, although iron and nickel sulphides also can be used, as well as other material containing sulphides of copper, nickel and iron.

Since nickel is removed from the process during the slag purificiation stage, those quantities of nickel charged to the slag fuming furnace are of no consequence to the process, which in turn means that the fuming of antimony is improved. It has been found that antimony fuming is dependent on whether the nickel content is low, as nickel binds the antimony which is then not fumed off. If the slag has a high content of nickel, the antimony content in it will therefore be largely collected in the matte formed in the settling furnace used to treat the slag after the slag fuming furnace. For economic reasons, this matte should be processed to recover its copper content, suitably by recirculation to the smelter. However, the result is that both nickel and antimony are returned to the process, and it is therefore a substantial advantage if the nickel-bearing slag is not taken to the slag fuming furnace.

The slag purification stage must be effected so that the slag comes into effective contact with the added sulphide material. This can be accomplished by agitating the slag in a separate furnace. Agitation of the slag can be used by rotating the furnace, by blowing a gas thereinto, or by creating induction currents therein. A preferred method is to treat the slag in a rotary furnace of the Kaldo-type for example, in which the slag can be quickly cleansed of practically all copper and nickel. The invention is illustrated by the following example.

EXAMPLE

About 2500 kg molten converter slag having an analysis of 7% Cu, 10.3% Zn, 0.58% Ni, 12.1% Pb, 22.8% $SiO_2$ and 0.15% Sb was transferred to a Kaldo-type converter and where the slag is treated with about 1000 kg copper concentrate with the analysis: 28% Cu 30% S 30% Fe 10% gangues (copper concentrates normally have an approximate composition of

| | |
|---|---|
| 20–30% | Cu |
| 25–35% | S |
| 30% | Fe |

and possibly small amounts of As, Pb, Sb, Zn in this case a copper concentrate from the Aitik mine was used having the analysis:

| | |
|---|---|
| 28% | Cu |
| 30% | S |
| 30% | Fe |
| 10% | gangues |

which was added continuously at the rate of about 40 kg/min., i.e. during a period of about 25 min. The copper concentrate reduces the converter slag, a portion of the iron content of the concentrate being directly slagged with silica sand added to the furnace. Iron was further slagged-out by blowing in oxygen through an oxygen lance in such a quantity that the copper content in the matte thus formed reached about 50%. Sand was assed to such an extent that the slag contained about 28% $SiO_2$. The composition of the rest of the slag was 0.90% Cu, about 9% Zn, 0.10% Ni and 0.12% Sb. As the added concentrate did not contain zinc or antimony these elements thus remained in the slag. The time taken for this treatment was about 30 min., and the converter rotation speed was between 20 and 35 r.p.m. The matte formed weighed 750 kg and contained:

| | | | | |
|---|---|---|---|---|
| 1,6% | Ni or 12 | kg | Ni i.e. | 80% of nickel present in the raw material |
| 0.08% | Sb or 0.6 | kg | Sb i.e. | 16% of antimony present in the raw material |
| 2% | Zn or 15 | kg | Zn i.e. | 6% of zinc present in the raw material |

This means that about 80% of the amount of nickel present in the converter slag before purification was separated.

The matte obtained was refined by blowing with oxygen-enriched air, whereat the sulphur in the matte was transformed to $SO_2$ and the iron content to iron oxide. At the same time $SiO_2$ was added for the formation of fayalite slag having 25–30% $SiO_2$. The slag was drawn off when a content of 78% Cu was reached in the white metal, now also containing the chief amount of nickel. The white metal, $Cu_2S$, weighed about 530 kg and contained about 2% or ca 11 kg Ni, the content of antimony and zinc being negligible.

A pre-requisite for blowing white metal to copper is that the iron content in the white metal is lower than about 0.3% by weight. If the iron content is greater, a very viscous magnetite slag is formed while blowing, which magnifies the difficulty in this operation to a large degree. It is therefore important that the blowing of the matte is carried out to such an extent that the copper content at least is 78%, in order to circumvent higher iron contents. The copper content in the slag formed when blowing the matte is dependent on the copper content of the white metal, especially if the copper content in the white metal exceeds 76%. If there is 78% copper in the white metal, its iron content is about 0.3%, the copper content in the slag then being about 4%.

By blowing the nickel-rich white metal with oxygen, an alloy of copper and the nickel content was formed.

We claim:

1. In a process for the production of copper comprising the steps of smelting in a smelter a copper raw material containing sulfur, zinc and more than 0.2% nickel based upon the copper content to a matte and a smelter slag, which smelter slag is treated in a slag fuming furnace to recover zinc;

converting in a converter said matte to white metal and a converter slag, said converter slag containing nickel, 4–8% copper and up to 15% zinc oxide;

separating the converter slag from said white metal in the converter and finally converting said white metal to copper, the improvement which comprises treating said converter slag containing zinc, copper and nickel to form a further slag and a second matte in a rotary furnace with an amount of sulfide material selected from the group consisting of copper sulfide material, iron sulfide material and nickel sulfide material sufficient to lower the copper content in said further slag to less than 2%, whereupon said further slag is taken to said slag fuming furnace and converting said second matte to a copper metal and a slag comprising the main part of the nickel content of the converter slag.

2. Process according to claim 1, wherein copper pyrite is used as said sulfide material for treating said converter slag.

3. Process according to claim 1, wherein nickel bearing copper pyries.

4. Process according to claim 1, wherein the treatment is effected in a rotary furnace of the Kaldo type.

5. In a process for the production of copper comprising the steps of smelting in a smelter a copper raw material containing sulfur, zinc and more than 0.2% nickel based upon the copper content to a matte and a smelter slag, which smelter slag is treated in a slag fuming furnace to recover zinc; converting in a converter said matte to white metal and a converter slag, said converter slag containing nickel, 4–8% copper and up to 15% zinc oxide; separating said converter slag from said white metal in the converter, and finally converting said white metal to copper; the improvement which comprises treating said converter slag containing zinc, copper and nickel to form a further slag and a second matte containing nickel in a rotary furnace with an amount of sulfide material selected from the group consisting of copper sulfide material, iron sulfide material and nickel sulfide material sufficient to lower the copper content in said formed further slag to less than 2%, taking said further slag to said slag fuming furnace and supplying oxygen to the second matte to reduce by oxidation the nickel content in said second matte after the separation of said further slag, thereby forming a nickel oxide slag and a third matte, separating said nickel oxide slag and recycling the third matte to said first named converting step.

6. Process according to claim 5 wherein copper pyrite is used as said sulfide material for treating said converter slag.

7. Process according to claim 5 wherein nickel bearing copper pyrites are used as said sulfide material for treating said converter slag.

8. Process according to claim 5 wherein the treatment is effected in a rotary furnace of the Kaldo type.

* * * * *